US009849939B2

(12) United States Patent
Hough et al.

(10) Patent No.: US 9,849,939 B2
(45) **Date of Patent: *Dec. 26, 2017**

(54) ARTICULATED TOP

(71) Applicant: Dowco, Inc., Manitowoc, WI (US)

(72) Inventors: Justin B. Hough, Lebanon, MO (US); Kenneth Lauerance Stout, Sheboygan Falls, WI (US)

(73) Assignee: Dowco, Inc., Manitowoc, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/428,375

(22) Filed: Feb. 9, 2017

(65) Prior Publication Data

US 2017/0152008 A1 Jun. 1, 2017

Related U.S. Application Data

(63) Continuation of application No. 14/934,291, filed on Nov. 6, 2015, now Pat. No. 9,604,702.

(60) Provisional application No. 62/076,971, filed on Nov. 7, 2014.

(51) Int. Cl.

| | |
|---|---|
| ***E04H 15/06*** | (2006.01) |
| ***B63B 17/02*** | (2006.01) |
| ***E04H 15/46*** | (2006.01) |
| ***E04H 15/48*** | (2006.01) |

(52) U.S. Cl.
CPC ..... *B63B 17/02* (2013.01); *E04H 15/06* (2013.01); *E04H 15/46* (2013.01); *E04H 15/48* (2013.01)

(58) Field of Classification Search
CPC ..... E04H 15/02; E04H 15/06; E04H 15/08; E04H 15/36; E04H 15/46; E04H 15/48; E04H 15/58
USPC ..... 135/88.01, 88.07, 88.15, 88.17, 96, 135/132–133, 139–140, 143–144, 151, 135/154, 117; 114/361, 343; 248/188.1–188.5
See application file for complete search history.

(56) References Cited

U.S. PATENT DOCUMENTS

| | | | |
|---|---|---|---|
| RE5,094 | E | 10/1872 | Mathewson |
| 3,489,452 | A | 1/1970 | Plante |
| 3,930,645 | A | 1/1976 | Anderson |
| 4,106,145 | A | 8/1978 | Gillen |
| 4,928,916 | A | 5/1990 | Molloy |
| 5,271,423 | A | 12/1993 | Eychaner |
| 5,472,301 | A | 12/1995 | Wallen |

(Continued)

FOREIGN PATENT DOCUMENTS

| | | |
|---|---|---|
| JP | 06090605 | 4/1994 |
| WO | WO2008010909 | 1/2008 |

OTHER PUBLICATIONS

Website screenshot of PWR-ARM Automatic Bimini Tip; https://pwr-arm.com; obtained from the Internet Archive Jun. 15, 2013.

(Continued)

*Primary Examiner* — Winnie Yip
(74) *Attorney, Agent, or Firm* — Shane Delsman; Godfrey & Kahn, S.C.

(57) ABSTRACT

A frame for a top of a boat in accordance with the present invention can be moved into an deployed position with the aid of a biasing member such that the manual effort required is minimized. When the frame is in the deployed position a locking member may be engaged to hold the frame and top in the deployed position. When the locking member is disengaged, the frame may be manually collapsed into a stowed position in a controlled and safe manner.

20 Claims, 15 Drawing Sheets

(56) References Cited

U.S. PATENT DOCUMENTS

| | | | |
|---|---|---|---|
| 5,645,309 | A | 7/1997 | Graf |
| 5,706,752 | A | 1/1998 | Menne, Jr. et al. |
| 5,740,998 | A | 4/1998 | Lindsay |
| 5,803,104 | A | 9/1998 | Pollen |
| 6,042,066 | A | 3/2000 | Maharg |
| 6,152,434 | A | 11/2000 | Gluck |
| 6,209,477 | B1 | 4/2001 | Biedenweg |
| 6,666,163 | B2 | 12/2003 | Pastor |
| 6,672,241 | B2 | 1/2004 | Warfel |
| 6,851,652 | B1 | 2/2005 | Huang |
| 6,983,716 | B1 | 1/2006 | Ankney et al. |
| 7,063,035 | B2 | 6/2006 | Belcher |
| 7,162,968 | B2 | 1/2007 | Thompson |
| 7,204,466 | B2 | 4/2007 | Hsieh |
| 7,290,472 | B2 | 11/2007 | Gass |
| 7,536,971 | B1 | 5/2009 | Fry |
| 7,571,691 | B2 | 8/2009 | Russikoff |
| 7,895,964 | B2 | 3/2011 | Russikoff |
| 7,921,797 | B2 | 4/2011 | James |
| 7,950,342 | B2 | 5/2011 | Russikoff |
| 8,052,110 | B2 | 11/2011 | Wang |
| 8,152,118 | B2 | 4/2012 | Melic |
| 8,590,849 | B2 | 11/2013 | Melic |
| 8,616,511 | B2 | 12/2013 | James |
| 8,708,100 | B2 | 4/2014 | Schwoerer |
| 8,752,498 | B1 | 6/2014 | Schwindaman et al. |
| 8,973,866 | B2 | 3/2015 | Ribarov |
| 8,973,899 | B2 | 3/2015 | Buckingham |
| 2008/0066794 | A1 | 3/2008 | Durfee |
| 2011/0290170 | A1 | 12/2011 | Russikoff |
| 2013/0206050 | A1 | 8/2013 | Russikoff |

OTHER PUBLICATIONS

Website screenshot of YouTube; PWR-ARM II, by Schwintek Inc.; uploaded on Oct. 19, 2011.

Website screenshot of Dowco Marine Inc.; http://www.dowcomarine.com/; obtained from the Internet Archive Jun. 23, 2015.

Website screenshot of Dowco Replacement Aft Top Canopy; Prior art for purposes of prosecution.

Peloton Precision Bicycle Products Hitch Perfect : Kuat NV product information; 2014 Move Press LLC.

ARTICULATED TOP

CROSS REFERENCE TO RELATED APPLICATION

This continuation application claims the benefit of and priority to Ser. No. 14/934,291, filed Nov. 6, 2015, which claims the benefit of and priority to U.S. Provisional Patent Application Ser. No. 62/076,971, the disclosures of which are hereby incorporated by reference, herein, in their entirety, for all purposes.

FIELD OF THE INVENTION

The present invention relates generally to the field of water craft. More specifically, the present invention relates to articulating tops for water craft.

BACKGROUND

Boats can be equipped with some form of sun shade apparatus or other enclosure such as a top, canopy or bimini. Some tops can be moved between an extended, engaged, locked or radar position and a stowed, collapsed, unlocked or trailering position. Some tops are constructed out of tubular frames that articulate to at least two positions. Some such tops can be manually articulated to a desired position, while others utilize mechanical aids such as hydraulics or electric motors to power the apparatus into the desired position(s).

The manual articulation of tops often require a significant effort to move the top into the desired position(s). One common method for manually articulating a top is to manually lift the top into the desired state, such as an extended position. Then, the top can be secured in position by latching or locking a frame member, such as a bow, arm or strut, such as to hardware that is attached to the water craft. Such manual articulation requires significant strength to raise the top into position, and dexterity and balance to secure the top in position. Such manual articulation can be unsafe if undertaken by a single person.

Some tops have been designed such that they use gravity to pull the top into the stowed position when released from the extended position. However, when released, such tops violently collapse, which can injure someone in the path of the top, damage the top and/or the water craft or be noisy, potentially scaring away wildlife. Other tops may use powered mechanical systems to decrease or even eliminate the need for manual articulation. However, such powered tops are often cost prohibitive and may not be useable with all boat models, as such powered tops can require specific structural elements for mounting thereto and power.

Therefore, there is need for a cost effective top that decreases the effort required to manually articulate the top. There is also a need for a top that can be manually articulated by one person without a sudden collapsing of the top and that can be securely stowed, such as for transportation and storage.

It will be understood by those skilled in the art that one or more aspects of this invention can meet certain objectives, while one or more other aspects can lead to certain other objectives. Other objects, features, benefits and advantages of the present invention will be apparent in this summary and descriptions of the disclosed embodiment, and will be readily apparent to those skilled in the art. Such objects, features, benefits and advantages will be apparent from the above as taken in conjunction with the accompanying figures and all reasonable inferences to be drawn therefrom.

DETAILED DESCRIPTION

Figure 1:
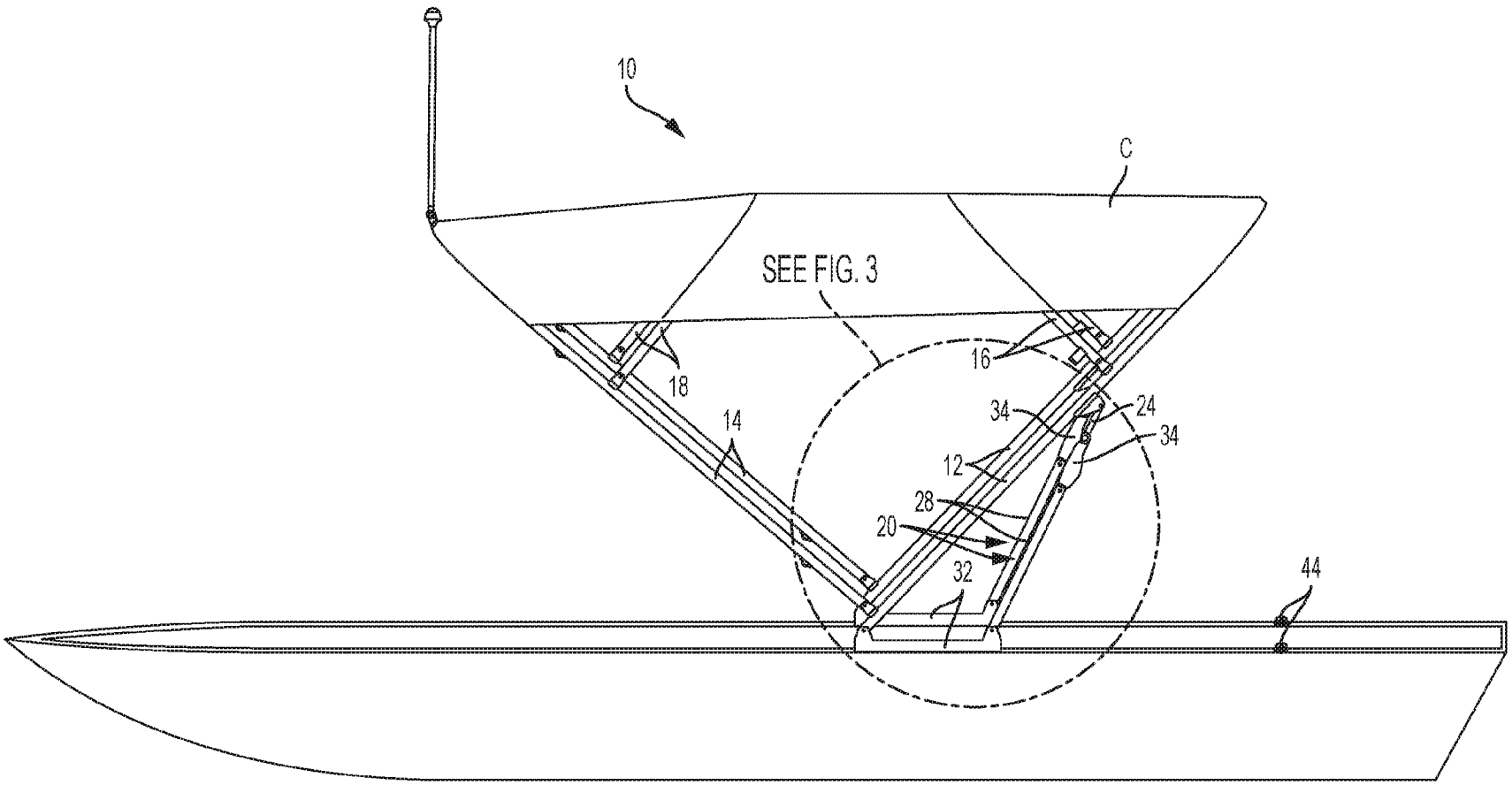
FIG. 1 is an elevation view of a frame in a deployed position.
Figure 2:
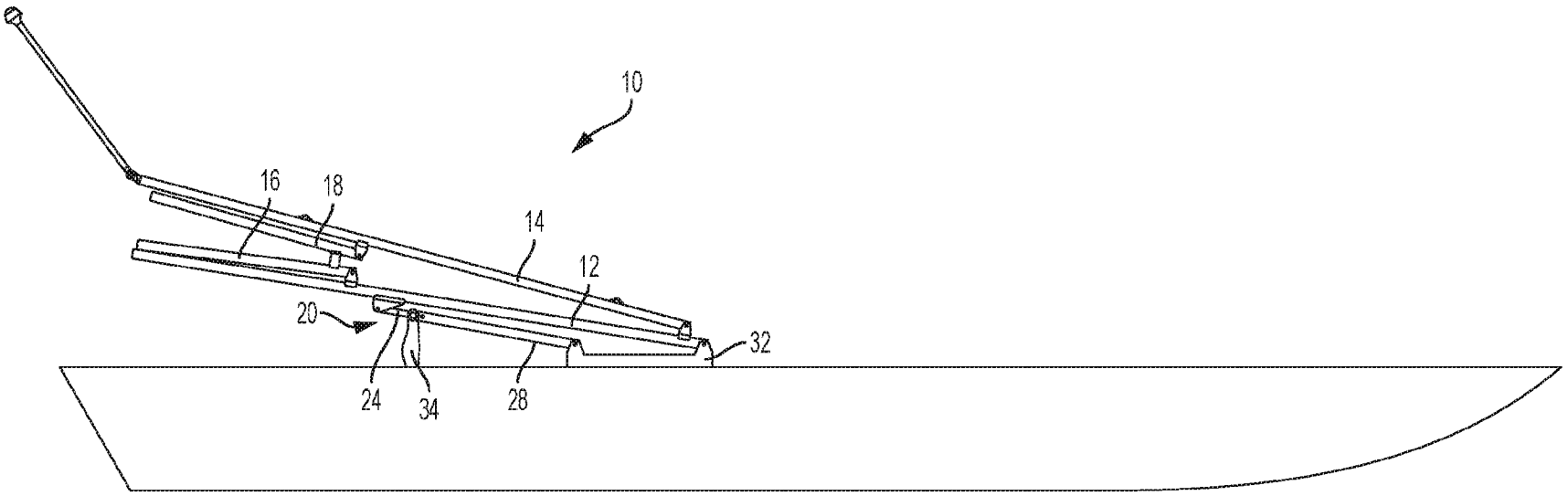
FIG. 2 is an elevation view of the frame of FIG. 1 in a collapsed position.

As seen in FIG. 1, a frame 10 for a marine top, canopy, bimini or other such structure is shown. The frame 10 shown in FIG. 1 is generally comprised of tubular members that support a canvas or other suitable material (not shown) for providing shade or sheltering from the elements. For example, the frame 10 in FIG. 1 includes a main or aft bow 12 that is pivotally connected to a secondary or bow bow 14. One or more auxiliary bows 16, 18 can be pivotally connected to the main and secondary bows. The pivotal connections allow the frame 10 to collapse into a compact folded frame as seen in FIG. 2. Support members 20, for example, one on the starboard side and one on the port side of the frame 10, may also be used to support and keep the frame in the deployed and/or collapsed position.

In the embodiment shown in FIG. 1, the support members 20 include a biasing member. The biasing member is shown in FIG. 1 as a gas shock 22, but could also include a mechanical or pneumatic spring, shock or damper. The gas shock 22 is connected at a first end to a first end of the strut or shaft 24, such as by a threaded end of the rod extending out of the enclosure of the gas shock, being thread into a threaded hole in the strut, and is pivotally connected directly or indirectly, at its second end to the vehicle or structure such as a boat, for example by an enclosure of the gas shock.

The strut 24 is pivotally connected at its second end to the frame 10 or a collapsible assembly, for example the main bow 12. For example, the strut 24 may have a bore (not shown) formed in one end and a plastic hat-style washer (not shown) inserted in each side of the hole. A frame bracket is then secured to the main bow, such as by screws or bolts. The frame bracket has flanges sized to accept the strut with hat-style washers and each flange has a hole matching the hole in the hat-style washers such that mating shoulder bolts may be inserted through the holes in the frame bracket, hat-style washers and strut 24 to pivotally connect the strut to the main bow. When the frame 10 is moved from the collapsed position, the gas shock 22 is allowed to push the rod 26 further out which in turn pushes the strut 24 out of the tube 28 and causes the main bow 12 and frame 10 to move to its deployed position. When the frame 10 moved from its deployed position towards its collapsed position, the main bow 12 will push on the strut 24 causing the rod 26 to be pushed in or withdrawn further into the gas shock 22.

In one embodiment, the gas shock 22 could be designed to provide just less than the amount of force required to move the frame 10 from the collapsed position into the extended position such that only a small amount of additional force or effort is needed, for example by a person. Such force would also allow the frame 10 to be collapsed into the stowed position in a safe and controlled manner because the weight of the frame would only slightly overcome the force exerted by the gas shock 22. Therefore, only a small amount of force is needed, for example by a person, to stop or slow the collapse of the frame 10. In this embodiment, the gas shock 22 urges or biases the strut 24 to slide into the tube 28.

By way of another example, the gas shock 22 could be designed to provide a slightly greater force than needed to move the frame 10 from the collapsed position into the extended position such that only a small amount of additional force would be used, for example by a person, to stop or slow the articulation of the frame 10. Such force would also allow the frame 10 to be collapsed into the stowed position in a safe and controlled manner because only a small amount of additional force or effort is used to overcome the force of the gas shock 22. In this embodiment, the gas shock 22 urges or biases the strut 24 to slide out of the tube 28.

Figure 3:
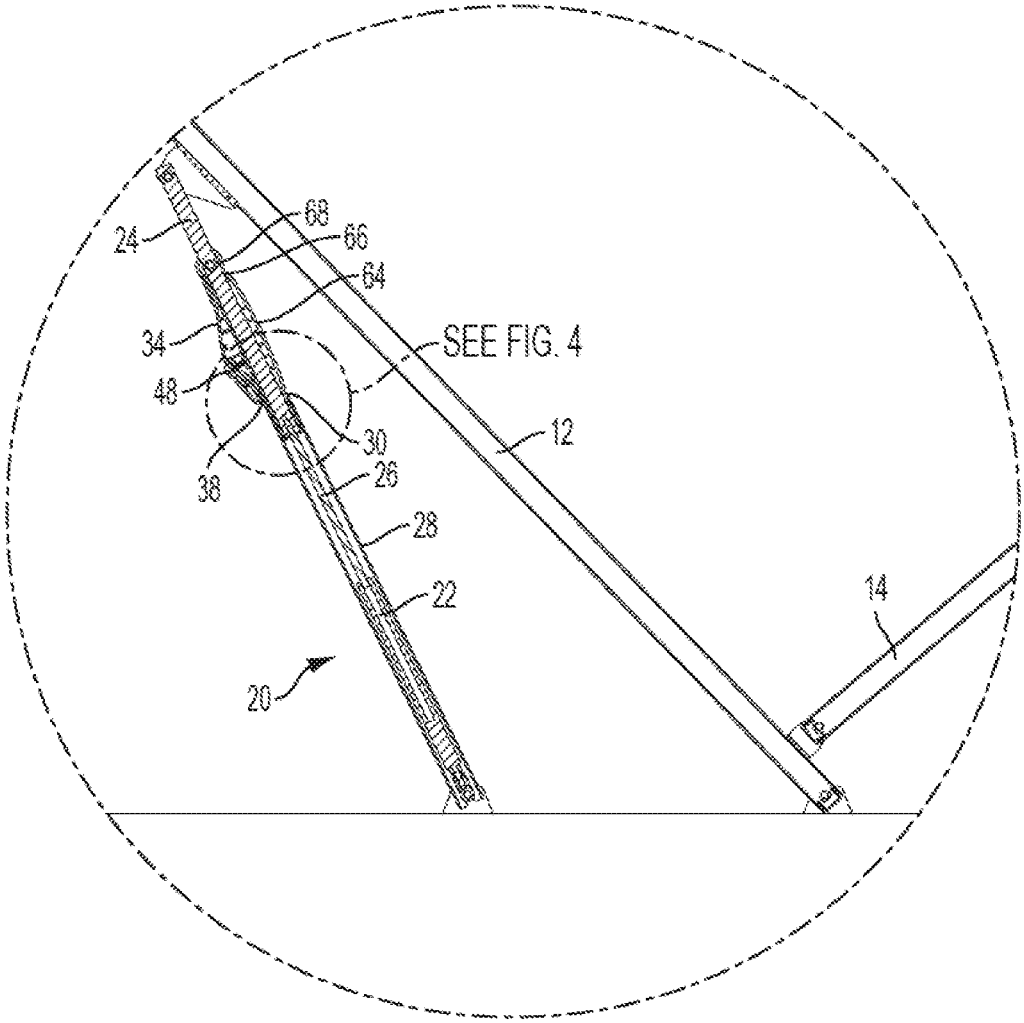
FIG. 3 is an enlarged elevation view of a portion of the frame of FIG. 1 attached directly to a water craft.

In the embodiment shown in FIG. 3, the gas shock 22 is housed within a tube, housing or shroud 28 and the tube slidable receives the strut 24. At one end of the tube 28 is a bushing or collar 30. In FIG. 3, the bushing 30 is located at least partially within the opening of the tube 28. The bushing 30 can slidably receive the strut 24 and help guide the strut as it slides in and out of the tube 28, such as, for example, by keeping the strut centered, providing a smooth surface for the strut to slide against and the preventing the strut from undesired racking or twisting. The bushing 30 could be attached to the tube 28 or the bushing could be integrally formed or made with the tube.

The support member 20 is shown attached at its second end to a mounting bracket 32. The second end of the gas shock 22 and/or the tube 28 can be attached directly to the marine vehicle or structure, e.g. a rail or fence, as seen in FIG. 3, or could be attached to another structure such as a mounting bracket 32 which is then attached to the marine vehicle or structure, as seen in FIGS. 1-2. For example, the tube 28 may have a bore (not shown) that matches a hole in the flanges (not shown) of the mounting bracket. Hat-style washers (not shown) are inserted into each side of the bore in the tube 28. Mating shoulder bolts are inserted through the hat-style washers, the tube 28 and an eyelet threadingly connected to the gas shock 22 to pivotally connect the tube and gas shock to the mounting bracket 32. The main bow 12 can also be pivotally attached to the mounting bracket 32.

Fixing or predetermining the relationship of the second ends of the main bow 12 and support member 20 can make installation easier because the proper relationship between the main bow and support member, e.g. angle formed by the main bow and mounting bracket 32 and distance between the second ends of the main bow and the support member, does not need to be determined or measured during installation. The proper relationship can also lead to increased safety and life of the frame 10 by, for example, inhibiting torqueing and proper distribution of the weight of the top on the main bow 12 and the support members 20. Fixing or predetermining the relationship of the second ends of the main bow 12 and support member 20 also allows a single sized support member to be used for a variety of sized tops and frames by adjusting the size of the mounting bracket 32.

Figure 6:
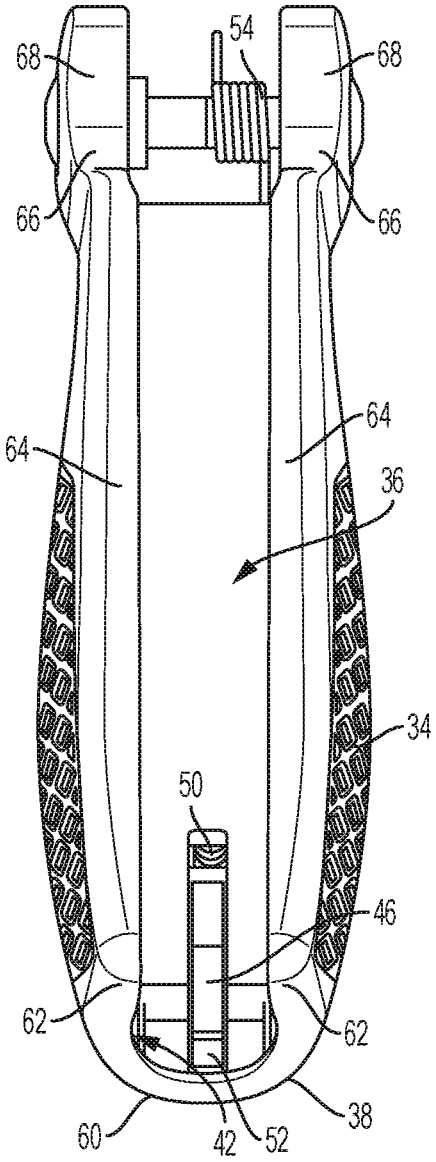
FIG. 6 is an enlarged perspective view of the locking member of the frame of FIG. 3.
Figure 7:
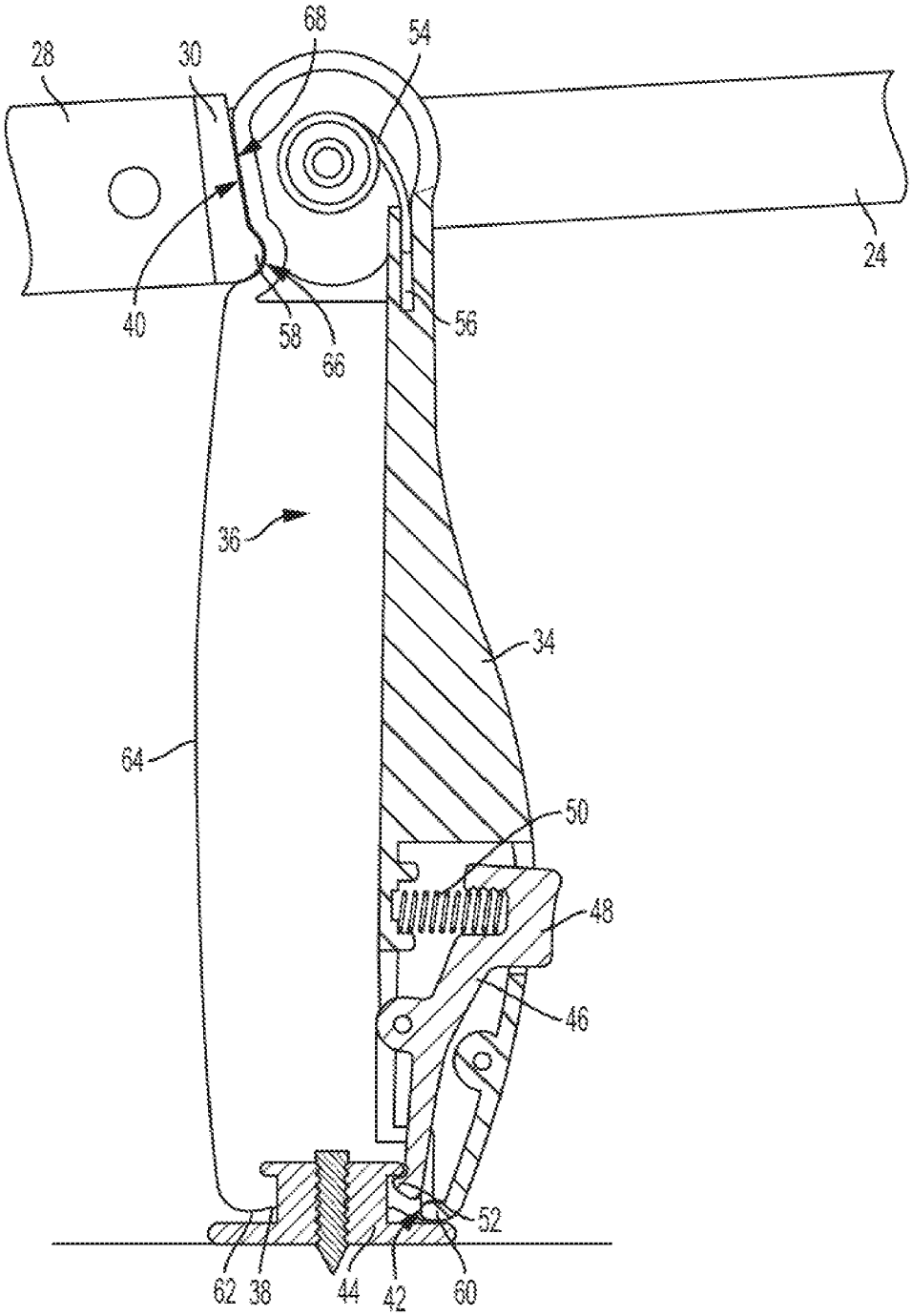
FIG. 7 is a cross-sectional elevation view of the locking member of FIG. 3 in an opened position engaged to a structure.

The support members 20 can also include a locking member lock the support member in the closed position, such as when the frame 10 is deployed, and/or the opened position, such as when the frame is collapsed. In FIGS. 1-11, 13, the locking member is a handle or lever that is pivotally connected to the strut 24, such that the locking member is movable between opened and closed positions. In one embodiment, the locking member 34 is attached to the exterior of the strut 24. For example, the handle 34 may have a bore (not shown) that matches a bore (not shown) in the strut 24 when the strut is within the handle as discussed further below. Mating shoulder bolts may be inserted through the two bores to pivotally mount the handle 34 to the strut 24 at one end of the handle. When the frame 10 is in its deployed position, the handle 34 is closed and generally in line with or parallel to the support member 20 as seen in FIG. 3. The handle 34 includes a slot 36 that is sized and positioned to accept the strut 24 when the handle is closed seen most clearly in FIG. 5. When the frame 10 is collapsed, the handle is opened and is generally perpendicular to the support member 20 as seen in FIG. 7.

Figure 4:
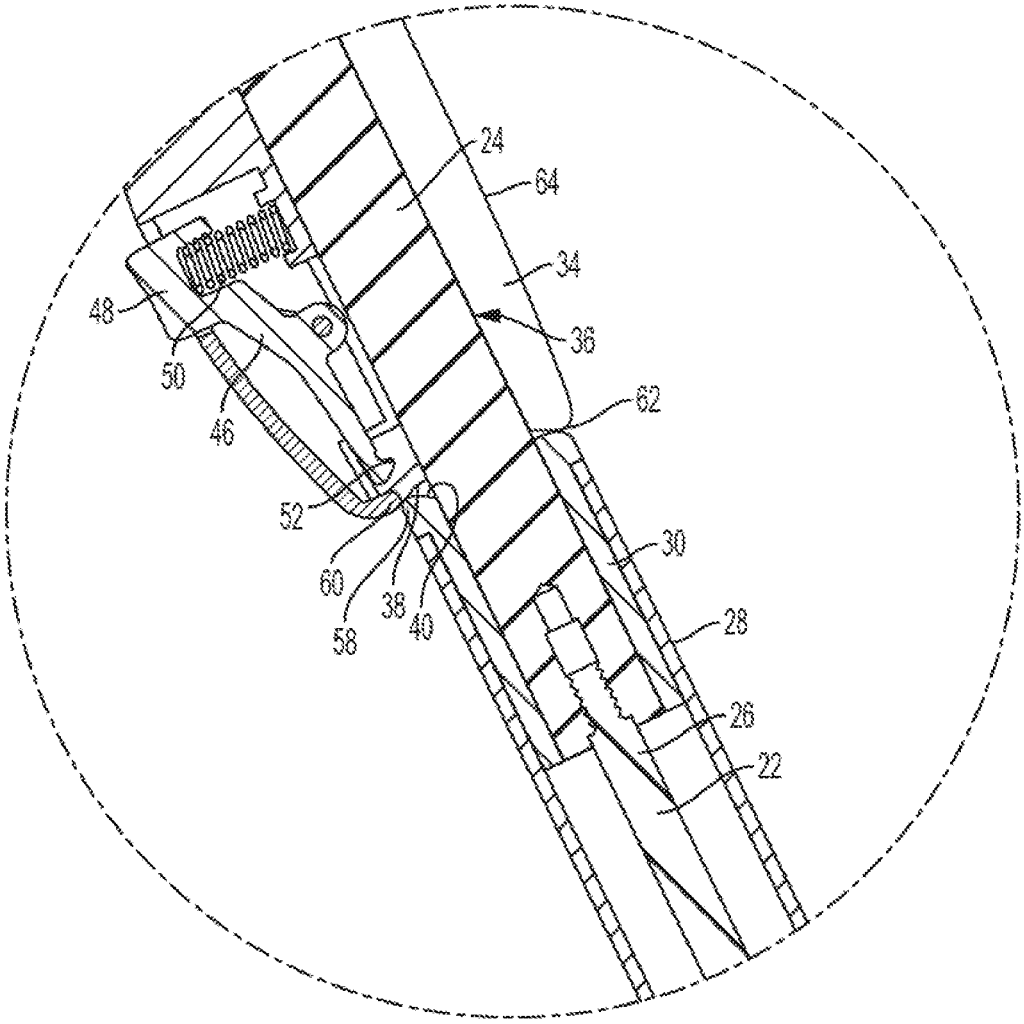
FIG. 4 is an enlarged elevation view of a portion of the frame of FIG. 3.
Figure 5:
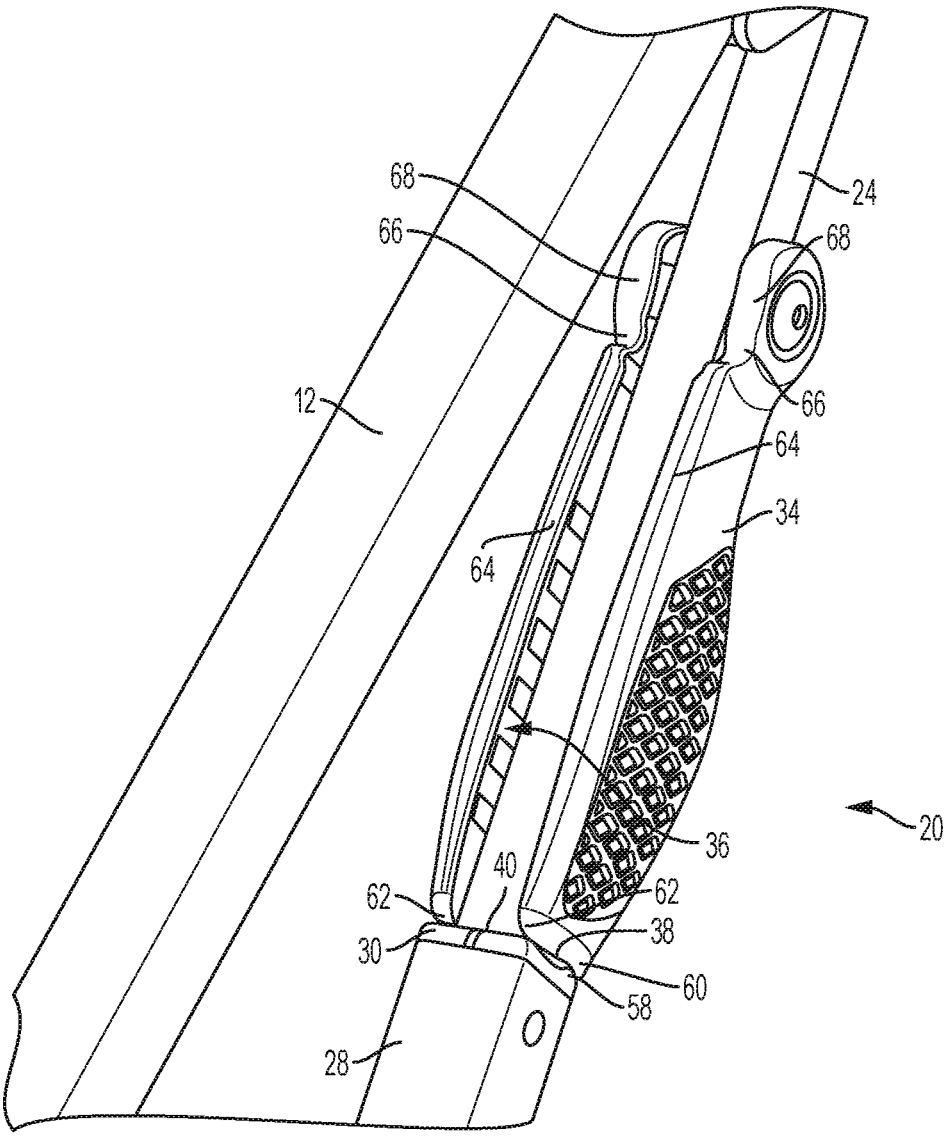
FIG. 5 is an enlarged perspective view of a portion of the frame of FIG. 1 in a closed position.

When the frame 10 is in the deployed position and the handle 34 is in a first position or closed, as seen in FIG. 4, the bottom surface 38 of the handle contacts, jams or engages the top or contact surface 40 of the bushing 30 to prevent the strut 24 from being pulled or sliding further within the tube 28 from the weight of the frame 10 and/or the tensile force or pull of the gas shock 22. When the handle is in the closed position, the frame 10 is fully deployed. Thereby, the handle 34 can be used to set the length and angle of the support member at which the frame 10 is fully deployed.

Figure 8:
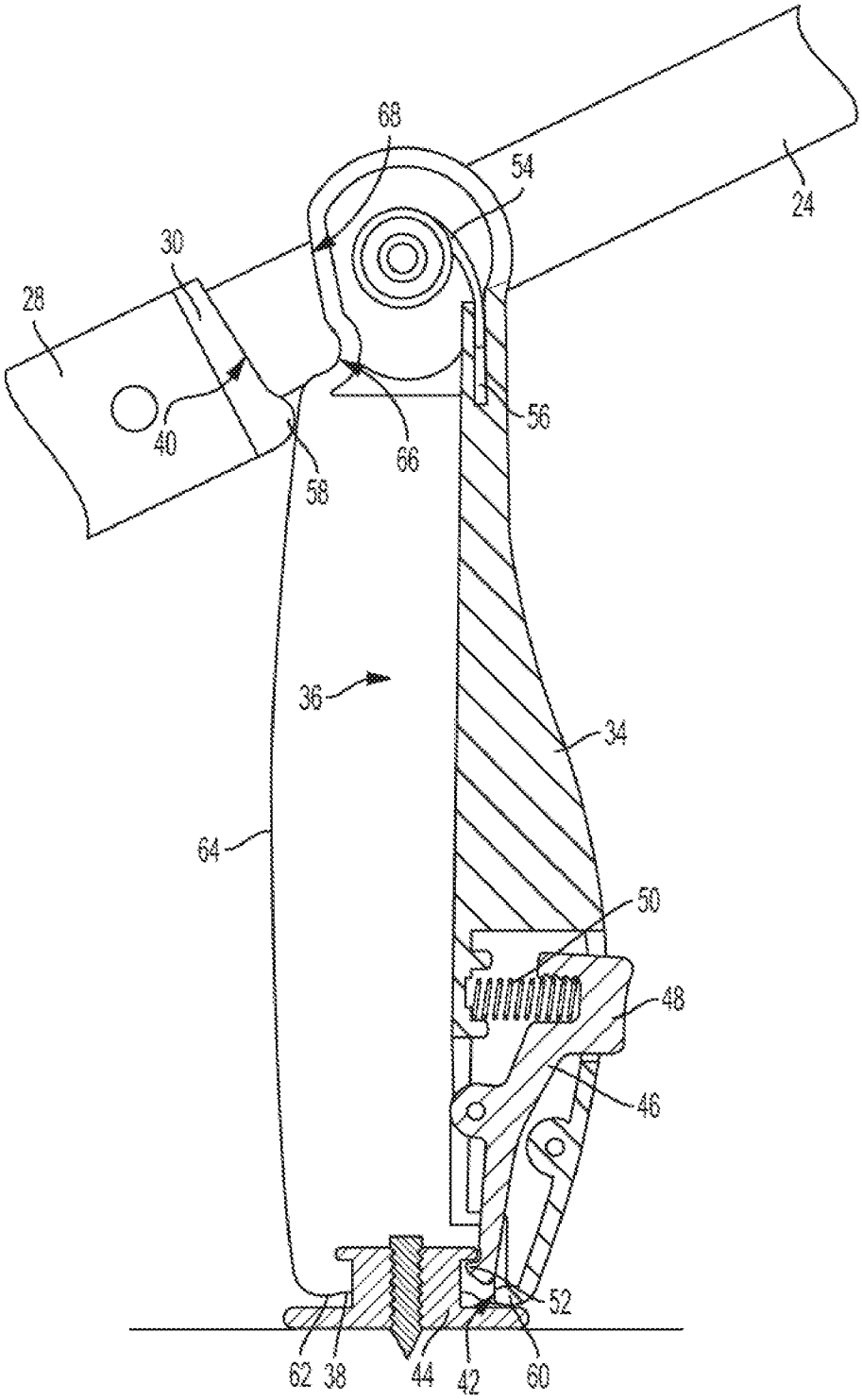
FIG. 8 is a cross-sectional elevation view of the locking member of FIG. 3 in an opened position.
Figure 9:
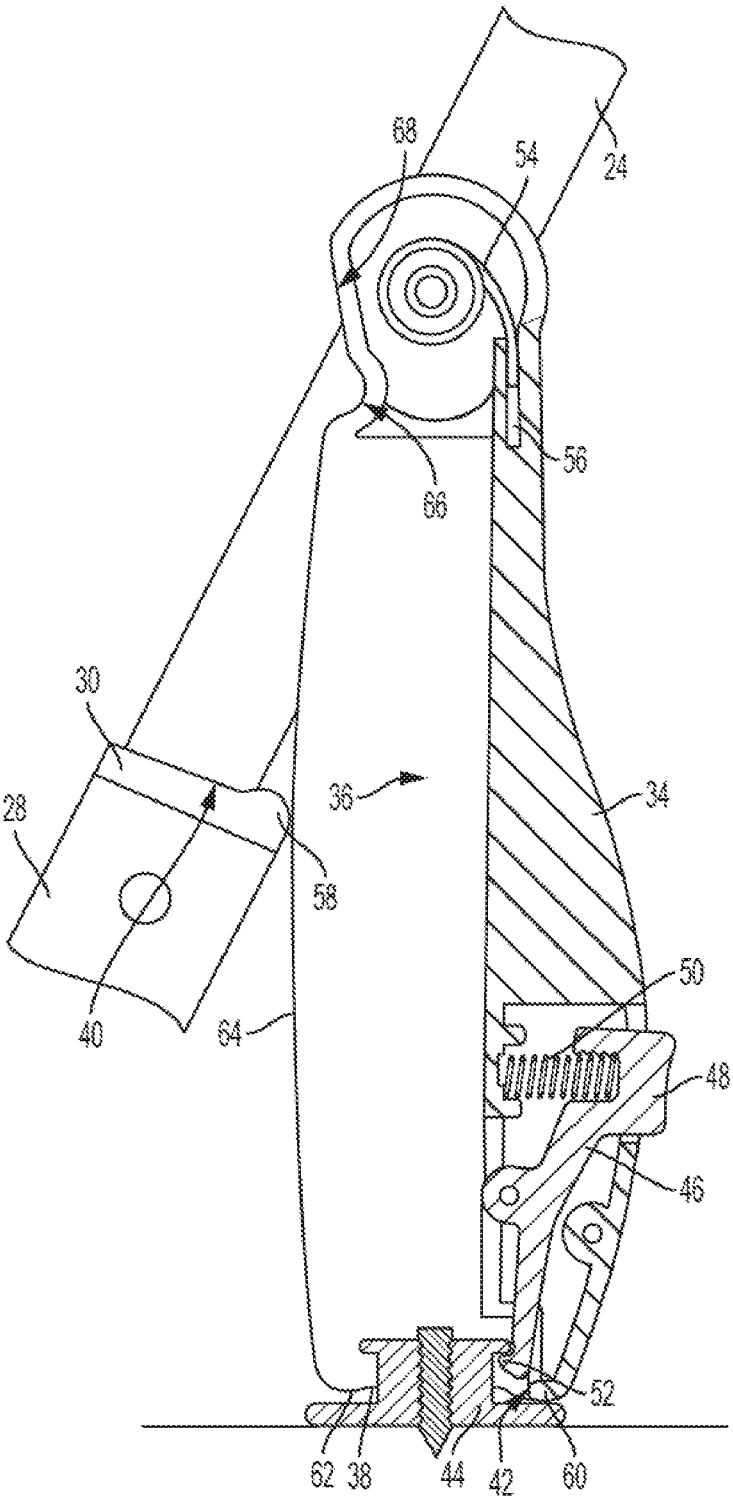
FIG. 9 is a cross-sectional elevation view of the locking member of FIG. 3 in an opened position.

When it is desired to collapse the frame 10, e.g. when towing a marine vehicle to which the frame is attached, the handle 34 can be disengaged from the bushing by pulling the handle and rotating the handle away from the support strut as seen in FIGS. 7-9. In this position, the handle 34 is in a second position or opened. When the handle 34 is in the open position, the strut 24 is not prevented from being pulled or sliding further within the tube 28 by the weight of the frame 10 and/or the tensile force or pull from the gas shock 22.

The handle 34 may also include a securing component to secure the frame 10 in a collapsed position. For example, as best seen in FIG. 6, the securing component is a socket 42 formed in the bottom of the slot 36. In the embodiment shown in FIGS. 6-7, the socket 42 is sized and shaped to selectively attach or fit over a structure, for example a deck button 44.

As seen in FIG. 7, a latch 46 is housed in and rotatably secured or pivotally connected to the handle 34. At a first end of the latch 46 is a push button 48. Between the push button 48 and the handle 34 is a spring 50 that urges the push button out of the handle. At the second end of the latch is a lip or flange 52. The spring 50 also urges the lip 52 into the slot 36.

To secure the frame 10 in the collapsed position, the socket 42 of the handle 34 is slid over the deck button 44. As the deck button 44 contacts the lip 52, the force pushes the lip away from the deck button and thereby, moves the latch to rotate to allow the deck button to further enter the slot 36 through the socket 42. Once the top of the deck button 44 moves past the lip 52, the spring 50 will cause the latch to rotate towards engagement with the deck button such that the lip 52 slides under the top of the deck button to secure the handle 34 and, thereby, the frame 10 to the marine vehicle or structure to which the deck button is attached. This is the engaged position of the latch. Although the above example uses a deck button, the socket 42 and/or latch 46 could be sized and shaped to connect to a variety of structures.

To release the frame from the deck button, for example, to move the frame to the deployed position, the push button 48 can be depressed causing the lip 52 to retreat from or disengage the deck button 44 and slot 36. With the lip 52 out of the way, the handle 34 can be withdrawn from the deck button. This is the disengaged position of the latch.

The handle 34 can also have a biasing member. For example, as seen in FIGS. 6-7, the handle includes a biasing member shown as a spring 54. The spring 54 is wound, wrapped or positioned over the bolt that pivotally connects the strut 24 to the handle 34. One end of the spring 54 is secured in a recess 56 formed in the back of the handle 34 and the other end of the spring is located in the strut 24. The spring 54 urges or biases the handle towards the closed position.

The contact surface 40 of the bushing 30 may also cooperate with the handle 34 and spring 54 to allow the handle to return to the closed position as the frame is being moved to the deployed position or to otherwise perform as a timing device. For example, as seen in the embodiment shown in FIG. 4, the contact surface 40 includes a raised edge 58. The bottom surface 38 of the handle 34 includes an interference or protuberant 60, 62 at each the front and back of the bottom surface.

When it is desired to move the frame 10 from the deployed position to the collapsed position, the handle 34 can be pulled away from the strut 24. As the handle 34 is pulled away the raised edge 58 will ride along the bottom surface 38 of the handle until the raised edge reaches the rear interference 62 of the bottom surface. A slight increase in the amount of force used to pull the handle 34 forward may be required to cause the rear interference 62 to ride up, over and beyond or pass the raised edge 58. In one embodiment, once the rear interference 62 is past the raised edge 58, the handle 34 will be in the open position and the weight of the frame will push the strut 24 down into the tube 28 because the weight of the frame is slightly greater than the resistance provided by the gas shock 22. As the strut 24 is pushed into the tube 28, the spring 54 will urge the handle 34 to maintain contact with the raised edge 58. The raised edge 58 will ride along the rear side 64 of the handle. As the strut 24 is being pushed into the tube 28, the contact between the raised edge 58 and the rear side 64 of the handle will cause the handle to rotate away from the strut 24.

In the embodiment shown in FIGS. 7-9, the raised edge 58 will ride the rear side 64 of the handle 34 until the raised edge reaches a depression 66 formed in the rear side 64 of the handle 34 and at least a portion of the remainder of the contact surface 40 contacts the stop surface 68 near the first end of the handle, as seen in FIG. 7. In this configuration, the handle 34 is in a third position or fully opened and can be placed onto the deck button 44. In the third position, the interaction between the handle 34 and bushing 30 prevents the strut 24 from sliding further into the tube 28 and defines or determines the amount the strut my slide or be further received within the tube. As seen in FIGS. 2 and 7-9, as the strut 24 slides into the tube 28, the handle 34 will be rotated further and further out of alignment with the strut, until the handle reaches the third position, wherein the handle is generally perpendicular to the strut.

When it is desired to move the frame 10 to the deployed position, the push button 48 can be depressed to release the deck button 44. Once the deck button 44 is past the lip 52 and the frame is moved towards the deployed position, the strut 24 will be withdrawn from the tube 28. As the strut 24 is withdrawn, the raised edge 58 will be withdrawn from the depression 66 and the spring 54 will cause the handle to maintain contact with the raised edge. The raised edge 58 will then ride along the rear side 64 of the handle 34, as seen in FIGS. 8-9, until it slides around the rear interference 62, the strut 24 enters the slot 36 and the bottom surface 38 contacts the contact surface 40, as seen in FIG. 4. This returns the handle to the closed position. The bottom surface 38 of the handle 34 can also include a front or second interference 60, to prevent the handle from being over rotated by the spring 54 thereby defining the maximum amount the spring may bias the handle.

The profile of the rear side 64 of the handle 34 and contact surface 40 of the bushing 30 can be shaped and sized to accomplish many features, functions and benefits, as can the bottom surface 38, depression 66 and stop surface 68. For example, the rear side 64 could have a depression at a location other than the end of the handle 34 or have an increased slope if it is not desired to have as much of the strut 24 withdrawn from the tube 28 when the frame 10 is in the collapsed position.

Figure 10:
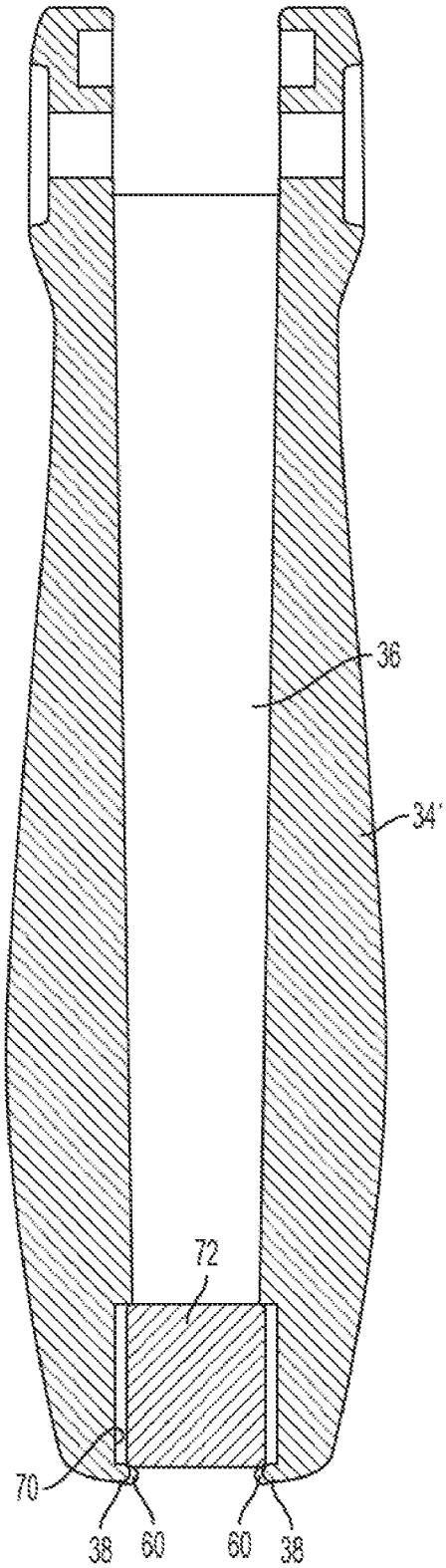
FIG. 10 is a cross-sectional elevation view of an alternative embodiment of a locking member engaged to a structure.

Another embodiment of a securing component is shown in FIG. 10. At the bottom surface 38 of the handle 34 is a bracket 70. The bracket 70 is sized and shaped so as to be able to connect to or clip or snap onto a structure such as a rail or fence 72.

Figure 11:
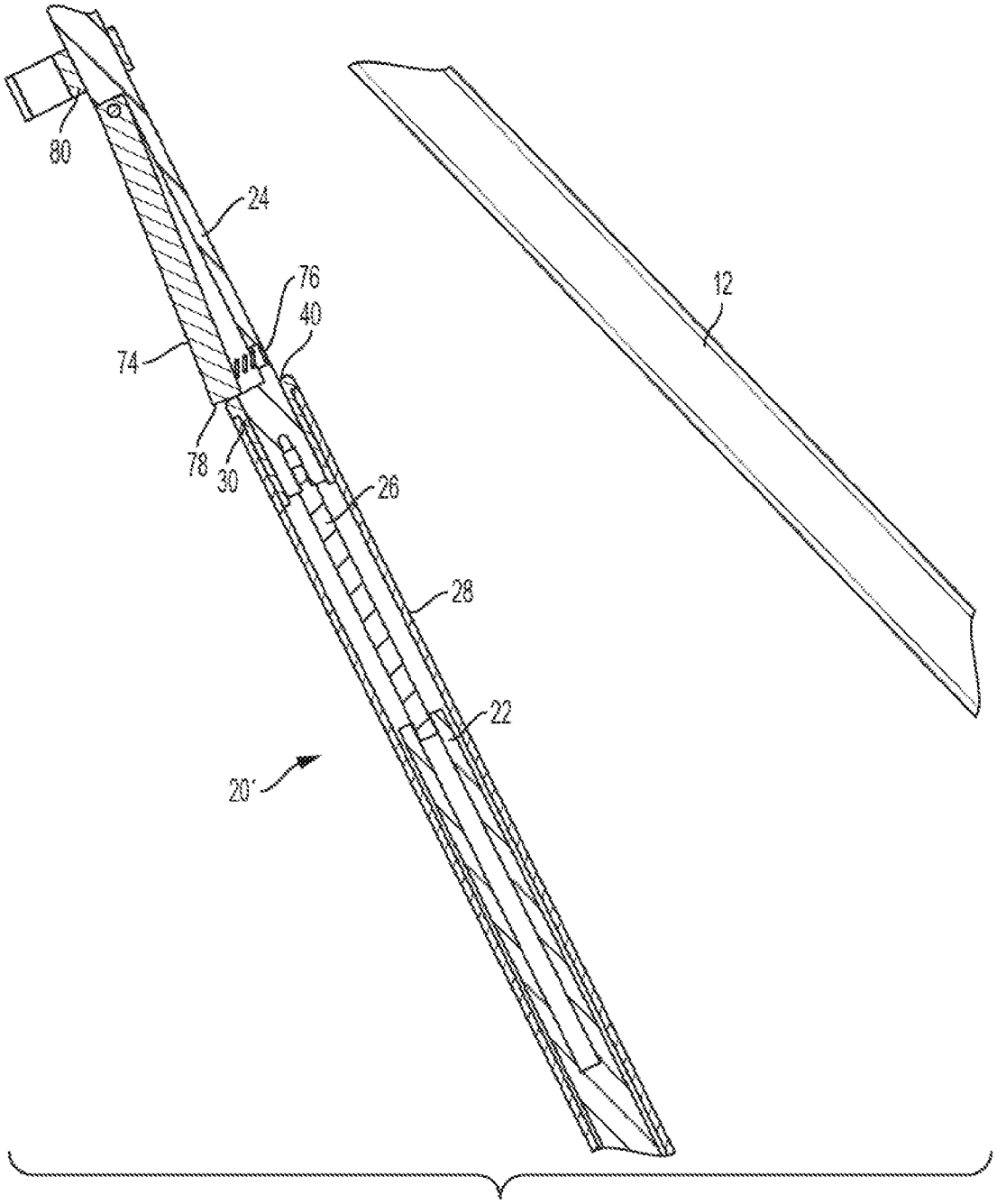
FIG. 11 is a cross-sectional elevation view of an alternative embodiment of a locking member in a closed position.
Figure 12:
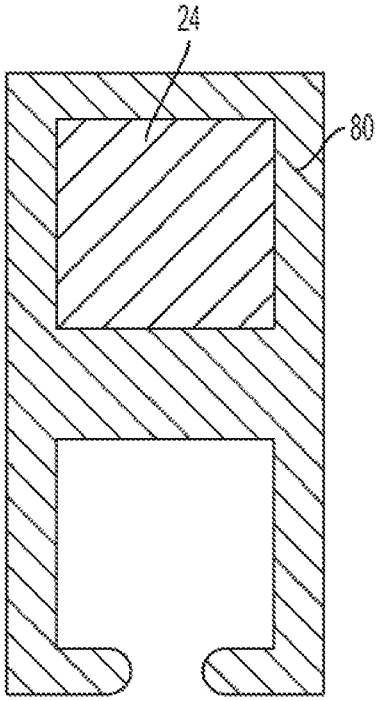
FIG. 12 is a cross-sectional elevation view of the bracket of FIG. 11.
Figure 13:
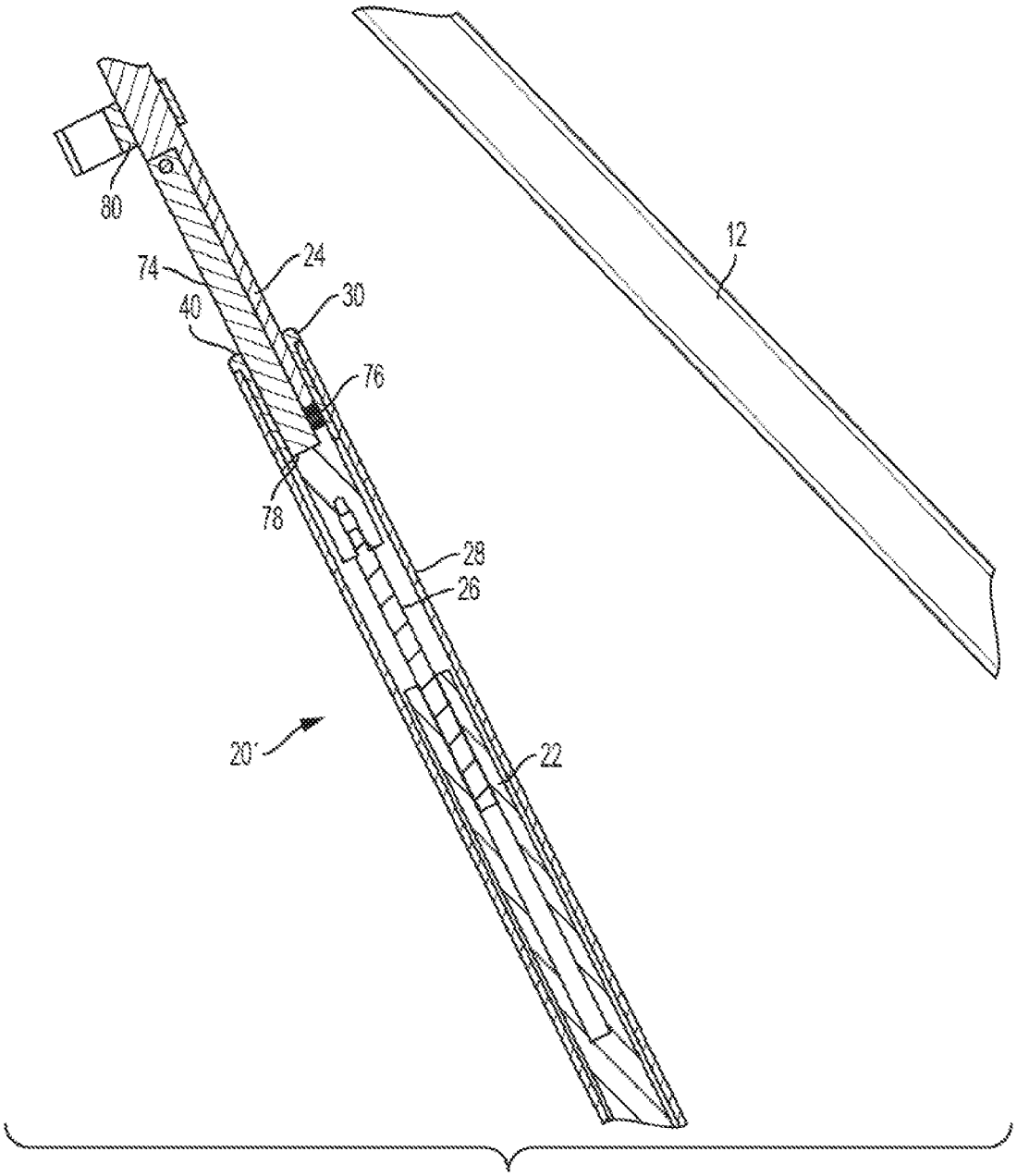
FIG. 13 is a cross-sectional elevation view of an alternative embodiment of a locking member in an opened position.

Another embodiment of a locking member for locking the support member 20' in the engaged position is shown in FIGS. 11, 13. As seen in FIGS. 11, 13, the locking member includes a lever 74 that is pivotally connected to and resides partially within the strut 24. A spring 76 is located between the bottom end of the lever 74 and the strut 24 to urge the bottom end of the lever out of the surface of the strut.

To move the frame 10 from an deployed position towards the collapsed position, the bottom portion of the lever must be pressed in towards the strut 24, against the force from the spring 76, such that the lever 74 and strut 24 can fit within the bushing 30 and be slid down into the tube 28 as seen in FIG. 13. When the frame is moved from the collapsed position towards the deployed position, and the strut 24 is sufficiently extended out of the tube 28, the spring 76 will urge the lever out of the strut 24. Once the lever 74 is out of the strut 24, the bottom or jam surface 78 of the lever will rest against the contact surface 40 of the bushing 30 to maintain the frame 10 in the deployed position and prevent the strut from being pushed down into the tube 28. The support member 20' could also include a bracket 80, such as an 'H' bracket, similar to that described above with regards to the bracket 70 shown in FIG. 10 to allow the frame 10 to be able to be secured in the collapsed position, such as to a rail or fence.

Figure 14:
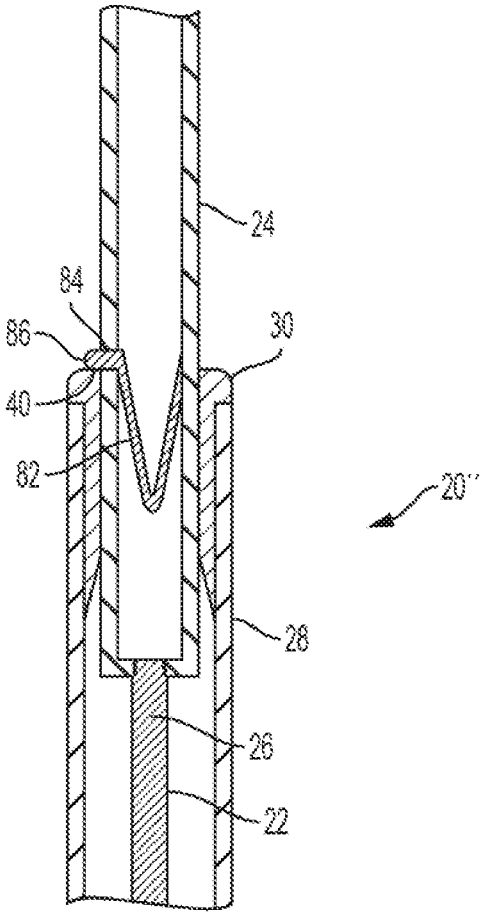
FIG. 14 is a cross-sectional elevation view of an alternative embodiment of a locking member in a closed position.
Figure 15:
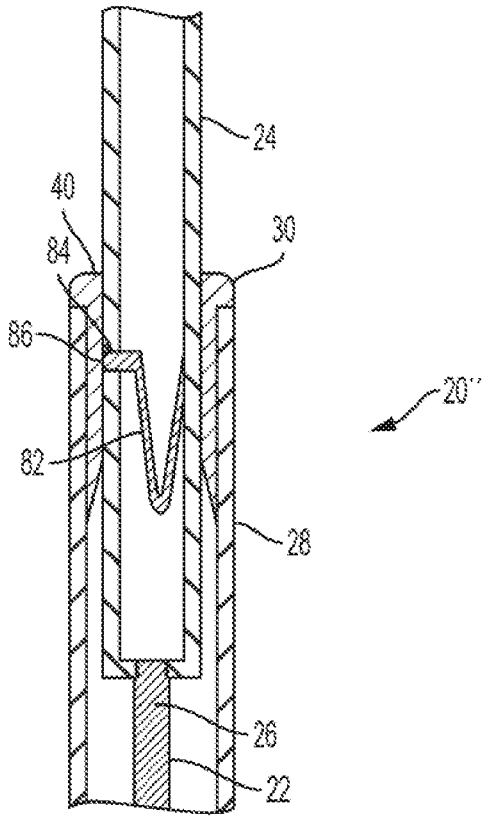
FIG. 15 is a cross-sectional elevation view of an alternative embodiment of a locking member in an opened position.

Another embodiment of a locking member for locking the support member 20" in the engaged position is shown in FIGS. 14-15. As seen in FIGS. 14-15, the locking member includes a spring locking pin 82 that is within the strut 24. When the frame 10 is moved from the collapsed position towards the deployed position, and the strut 24 is sufficiently extended out of the tube 28, a hole 84 will no longer be blocked by the bushing 30 or the tube 28 such that the pin 86 of the spring locking pin 82 will be urged out of the hole. Once the pin 86 is out of the strut 24, the pin will rest against the contact surface 40 of the bushing 30 to maintain the frame 10 in the deployed position and prevent the strut from being pushed down into the tube 28 as seen in FIG. 14. When it is desired to move the frame 10 from the deployed position to the collapsed position, the pin 86 of the spring locking pin 82 can be pushed into the strut 24 so that the strut is free to be withdrawn into the tube 28 as seen in FIG. 15. The support member 20" could also include a bracket 80 as previously described.

Although the invention has been herein described in what is perceived to be the most practical and preferred embodiments, it is to be understood that the invention is not intended to be limited to the specific embodiments set forth above. For example, although the support member is described as being used in a frame for a marine top, the support member could be used in a variety of applications including different collapsible structures. Rather, it is recognized that modifications may be made by one of skill in the art of the invention without departing from the spirit or intent of the invention and, therefore, the invention is to be taken as including all reasonable equivalents to the subject matter of the appended claims and the description of the invention herein.

What is claimed is:

1. A frame for a structure, the frame comprising:
- a bow for connecting to the structure;
- a housing for pivotally connecting to the structure;
- a biasing member having a rod extending out of the biasing member, the biasing member located at least partially within the housing;
- a strut connected at a first end to the rod and pivotally connected at a second end to the bow; and
- a locking member pivotally connected to the strut such that when the locking member is in a first position the strut is prevented from sliding in the housing and when the locking member is in a second position, the strut is not prevented from sliding in the housing;
- wherein the locking member has a slot and when the locking member is in the first position, the strut at least partially resides in the slot.

2. The frame of claim 1, wherein the locking member is in the first position when a bottom of the locking member contacts the housing.

3. The frame of claim 2, wherein the locking member is in the second position when a side of the locking member contacts the housing.

4. The frame of claim 1, wherein when the locking member is in the second position, the frame can be collapsed and when the locking member is in the first position, the frame cannot be collapsed.

5. The frame of claim 1, further comprising a bushing attached to an end of the housing and wherein the strut is at least partially guided by the bushing when the locking member is moved from the first position to the second position.

6. The frame of claim 1, wherein the locking member is movable to a third position that determines an amount the strut may slide within the housing.

7. The frame of claim 6, wherein when the locking member is in the third position, the locking member is generally perpendicular to the strut.

8. The frame of claim 6, wherein when the locking member is the third position, the strut is prevented from further sliding in the housing.

9. The frame of claim 1, wherein when the locking member is in the first position, the locking member is generally in line with the housing.

10. A support member for a collapsible assembly attached to a structure, the support member comprising:
- a biasing member having an enclosure and an end configured for attaching to the structure;
- a shaft slidably received by the enclosure and having an end for attaching to the collapsible assembly,
- a lever attached at one end to the shaft;
- wherein when the lever is generally parallel to the shaft, the collapsible assembly cannot be collapsed and when the lever is not generally parallel to the shaft, the collapsible assembly can be collapsed;
- wherein when the lever is generally parallel to the shaft, a bottom surface of a second end of the lever contacts the enclosure to prevent the shaft from being further received in the enclosure.

11. The support member of claim 10, wherein the structure is a mounting bracket.

12. The support member of claim 10, wherein the biasing member biases the shaft to slide into the enclosure when the lever is not generally parallel to the shaft.

13. The support member of claim 10, wherein the biasing member biases the shaft to slide at least partially out of the enclosure when the lever is not generally parallel to the shaft.

14. The support member of claim 10, wherein the lever has an interference at the second end and wherein the interference must pass over a raised edge of the enclosure to so as not to be generally parallel to the shaft.

15. The support member of claim 14, wherein the lever has a spring to urge the lever towards the shaft and a second interference at the second end that defines a maximum amount the spring may bias the lever.

16. The support member of claim 15, wherein as the contact between the raised edge and the side of the lever moves further away from the second end of the lever, the lever is rotated further out of line with the strut.

17. The support member of claim 10, wherein when the lever is in the second position and the collapsible assembly is collapsed, the lever may be used to attach the collapsible assembly to the structure.

18. The support member of claim 10, wherein the lever is attached at one end to the exterior of the shaft.

19. A frame for a structure, the frame comprising:
- a bow for connecting to the structure;
- a housing for pivotally connecting to the structure;
- a biasing member having a rod extending out of the biasing member, the biasing member located at least partially within the housing;
- a strut connected at a first end to the rod and pivotally connected at a second end to the bow;
- a locking member pivotally connected to the strut such that when the locking member is in a first position the strut is prevented from sliding in the housing and when the locking member is in a second position, the strut is not prevented from sliding in the housing; and wherein when the locking member is in a third position, the locking member is generally perpendicular to the strut.

20. A support member for a collapsible assembly attached to a structure, the support member comprising:

a biasing member having an enclosure and an end configured for attaching to the structure;

a shaft slidably received by the enclosure and having an end for attaching to the collapsible assembly;

a lever attached at one end to the shaft;

wherein when the lever is generally parallel to the shaft, the collapsible assembly cannot be collapsed and when the lever is not generally parallel to the shaft, the collapsible assembly can be collapsed; and wherein a side of the lever will ride against a portion of the enclosure as the strut slides into the enclosure.

* * * * *